United States Patent [19]

Melcher et al.

[11] 4,307,530

[45] Dec. 29, 1981

[54] CYLINDER LATCH MECHANISM FOR REVOLVERS

[75] Inventors: Roy L. Melcher, Stratford; Harry H. Sefried, II, New Haven, both of Conn.

[73] Assignee: Sturm, Ruger & Company, Inc., Southport, Conn.

[21] Appl. No.: 140,985

[22] Filed: Apr. 17, 1980

[51] Int. Cl.[3] ..... F41C 1/00

[52] U.S. Cl. ..... 42/67

[58] Field of Search ..... 42/67, 65

[56] References Cited

U.S. PATENT DOCUMENTS

| | | | |
|---|---|---|---|
| 887,784 | 5/1908 | Fyrberg | 42/67 |
| 2,863,249 | 12/1958 | Koucky et al. | 42/67 |
| 3,654,720 | 4/1972 | Ruger | 42/65 |
| 3,768,190 | 10/1973 | Ruger et al. | 42/65 |
| 3,777,384 | 12/1973 | Ruger et al. | 42/65 |

*Primary Examiner*—Charles T. Jordan

*Attorney, Agent, or Firm*—Pennie & Edmonds

[57] ABSTRACT

A revolver having essentially conventional cylinder, trigger, and cylinder pawl is provided with a novel and positive acting cylinder latch arrangement wherein the trigger has a trigger pivot portion formed with a transverse pivot hole and with a longitudinally extending actuator receiving slot through which the trigger pivot pin extends, a cylinder latch actuator is slidably mounted within said actuator receiving slot and on said trigger pivot pin for limited longitudinal and rotational movement on said pin within said slot, and a cylinder latch is pivotably mounted for rotation of the nose portion thereof into and out of engagement with the cylinder latch notches formed in the outer surface of the cylinder. Rotation of the trigger from its at-rest position to its ready-to-fire position causes the cylinder latch actuator to contact and depress and then to release the cylinder latch thereby causing the nose portion of the cylinder latch to rotate out of engagement with one of the cylinder notches and then to rotate into engagement with the next cylinder latch notch of the cylinder. Rotation of the trigger in the opposite direction causes the cylinder latch actuator to press against the cylinder latch and thereby to move the cylinder latch actuator longitudinally rearwardly a sufficient distance to allow the forward end of said cylinder latch actuator to clear the rearward end of said cylinder latch.

7 Claims, 7 Drawing Figures

CYLINDER LATCH MECHANISM FOR REVOLVERS

TECHNICAL FIELD

This invention relates to revolvers and more particularly to an improved cylinder latch mechanism for the rotatable cylinder of a revolver.

BACKGROUND ART

Conventional revolvers have a frame, a barrel secured to the forward end of the frame, a cylinder rotatably mounted on the frame, the cylinder being formed with a plurality of chambers each of which is adapted to receive a cartridge and each moving successively into alignment with the barrel when the cylinder is rotated, a hammer pivotably mounted on the frame in a position to strike a cartridge contained in the uppermost chamber of the cylinder, a trigger pivotably mounted below the cylinder for rotation from its at-rest position to its ready-to-fire position when the hammer is cocked, a cylinder pawl for rotating the cylinder when the hammer is cocked or when the trigger is pulled, and a cylinder latch for preventing rotation of the cylinder when the revolver is fired. The outer surface of the cylinder is formed with a plurality of cylinder latch notches each corresponding to one of the cartridge receiving chambers of the cylinder, and the cylinder latch has a nose portion that is adapted to releasably engage each of the cylinder latch notches of the cylinder in succession (usually, the lowermost cylinder notch) as the cylinder is rotated. The nose of the cylinder latch engages the lowermost of the cylinder latch notches of the cylinder to maintain the uppermost chamber of the cylinder in alignment with the barrel of the revolver when the firing mechanism of the revolver is in its ready-to-fire condition and is withdrawn from engagement with said notch when the cylinder is rotated to bring the next chamber into alignment with the barrel of the revolver.

It is important that the nose of the cylinder latch firmly engage the lowermost of the cylinder notches of the cylinder to prevent rotation of the cylinder when the firing mechanism of the revolver is in its ready-to-fire condition. Moreover, after the revolver has been fired and the hammer and trigger have returned to their respective at-rest positions, it is equally important that the cylinder be free to rotate to bring the next chamber thereof into alignment with the barrel when the revolver is being cocked in preparation for the next shot. Accordingly, as previously noted the cylinder latch first must be moved to withdraw the nose portion thereof from engagement with the lowermost of the cylinder latch notches and then must be released to permit the nose portion to engage the next cylinder latch notch when the next chamber of the cylinder moves into alignment with the barrel. More specifically, when the hammer and the trigger are rotated from their at-rest to their ready-to-fire positions, the nose of the cylinder latch is withdrawn temporarily from engagement with the lowermost of the cylinder latch notches of the cylinder, the cylinder pawl is moved upwardly to engage the indexing ratchets of the cylinder and thereby commence rotation of the cylinder, and then the cylinder latch is released to allow the nose thereof to contact and slide along the outer surface of the rotating cylinder, the nose of the cylinder latch slipping into and engaging the next (and now the lowermost) cylinder latch notch when the uppermost chamber corresponding thereto moves into alignment with the barrel of the revolver. The movement of the hammer, trigger, cylinder pawl, cylinder latch, and cylinder must be carefully coordinated to achieve the desired disengagement and reengagement of the cylinder and cylinder latch without allowing the cylinder to become misaligned with the barrel at the moment the revolver is fired. A number of cylinder latch mechanisms have heretofore been devised to successfully accomplish this result among which are those disclosed in U.S. Pat. Nos. 3,654,720, 3,768,190, and 3,777,384 to Ruger et al.

U.S. Pat. No. 3,654,720 discloses an advantageous trigger guard assembly for a revolver wherein the trigger and cylinder pawl (as well as certain other parts of the firing mechanism) are mounted on the trigger guard which, in turn, is removably mounted on the underside of the frame of the revolver. This construction greatly simplifies the assembly and disassembly of the revolver and also greatly strengthens the frame of the revolver by eliminating the need for a separate side plate that must be removed when a revolver of conventional construction is disassembled for cleaning or repair. The cylinder latch of this revolver is a separate part that is not actually secured to any other part, the cylinder latch being maintained in its operational position by the adjacent parts of the firing mechanism and frame when the revolver is properly assembled. This can lead to some inconvenience if the separate cylinder latch is mislaid during disassembly or is incorrectly positioned when the revolver is reassembled.

We have now devised an improvement in the cylinder latch mechanism of revolvers that eliminates the possibility of loss of the cylinder latch or misassembly of the mechanism itself by securely mounting the pivoted cylinder latch on the frame or on the trigger guard of the revolver. The mechanism is rugged and reliable and is provided with a cylinder latch actuator that is automatically locked in its cylinder latch actuator position when the revolver is being cocked, thereby further reducing the possibility of malfunctioning of the mechanism. Other important advantages of the cylinder latch mechanism will become apparent from the ensuing detailed description thereof.

SUMMARY OF THE INVENTION

The improved cylinder latch arrangement of the invention is applicable to conventional revolvers of the type described above. In broadest terms it comprises a trigger having a trigger pivot portion that is formed with a longitudinally extending actuator receiving slot through which the trigger pivot pin extends and with an actuator restraining lug that extends transversely over the actuator receiving slot formed in the pivot portion of the trigger, a cylinder latch actuator slidably mounted within the actuator receiving slot and on the trigger pivot pin for limited longitudinal and rotational movement on said pin within said slot, a cylinder latch having a nose portion adapted to engage the cylinder latch notches of the cylinder and a foot portion adapted to engage the forward end of the cylinder latch actuator, and spring means urging the forward end of the cylinder latch actuator into engagement with the foot portion of the cylinder latch. Rotation of the trigger from its at-rest position to its ready-to-fire position causes the forward end of the cylinder latch actuator to contact and press against the foot portion of the cylinder latch and thereby move the forward end of the cylinder latch actuator upwardly into engagement with the actuator restraining lug of the trigger to block rearward movement of said actuator and also thereby move the foot portion of the cylinder latch downwardly to rotate the nose portion of the cylinder latch out of engagement with one of the cylinder latch notches of the cylinder, the cylinder latch actuator then releasing the foot portion of the cylinder latch to allow the nose portion thereof to rotate upwardly into engagement with the next cylinder latch notch of the cylinder. Rotation of the trigger from its ready-to-fire position to its at-rest position causes the forward end of the cylinder latch actuator to press upwardly against the foot portion of the cylinder latch and thereby move the cylinder latch actuator downwardly out of engagement with the actuator restraining lug of the trigger and then move rearwardly a sufficient distance to allow the forward end of the cylinder latch actuator to clear the rearward end of the foot portion of the cylinder latch.

The revolver is advantageously provided with a trigger guard that is removably mounted on the frame below the cylinder, the trigger, the cylinder latch actuator, and the cylinder latch being pivotably mounted on said removable guard.

DESCRIPTION OF THE DRAWINGS

The cylinder latch mechanism of the invention will be better understood from the following description in conjunction with the accompanying drawings of which.

BEST MODE FOR CARRYING OUT THE INVENTION

Figure 1:
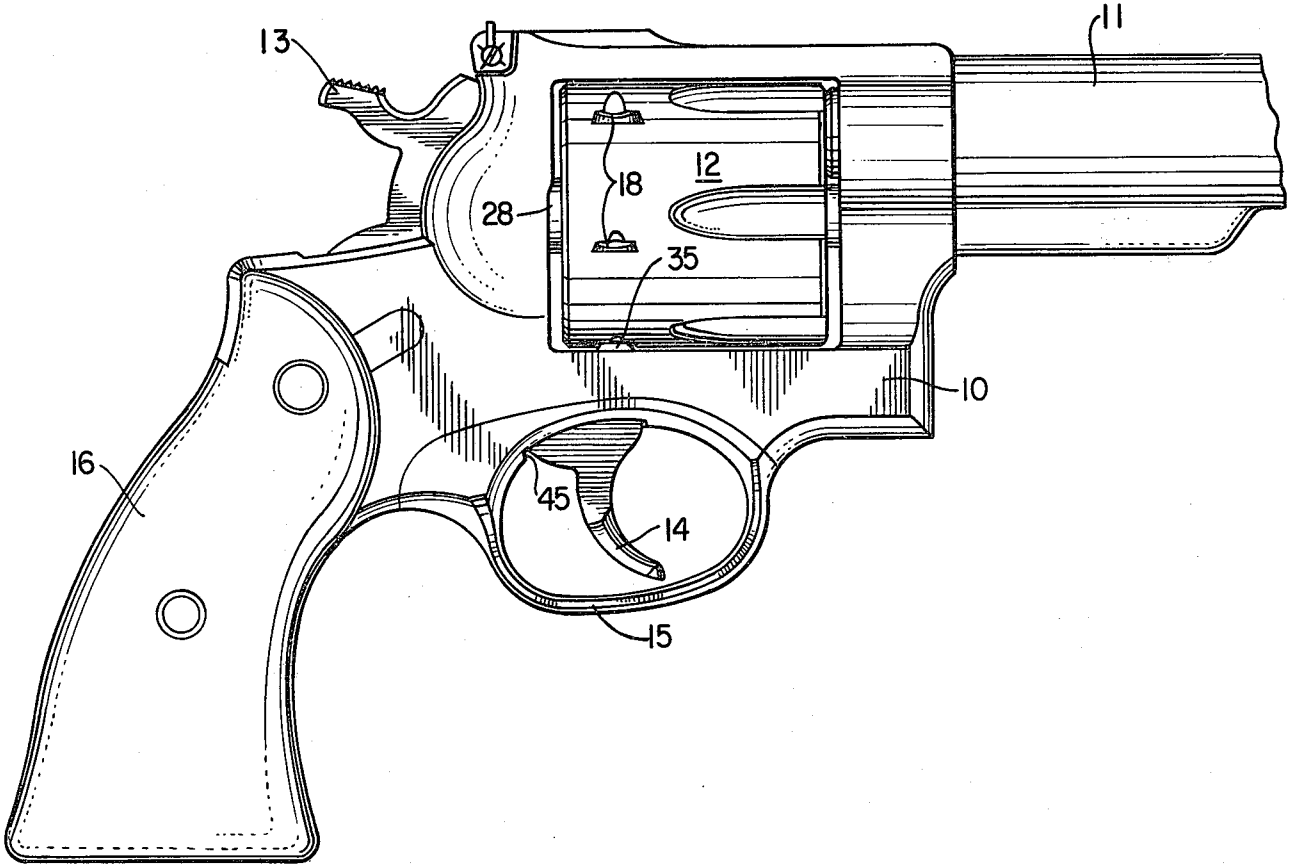
FIG. 1 is a side elevation of one type of revolver to which the present invention relates.

The cylinder latch mechanism of the invention will be described in conjunction with a revolver of the type shown in U.S. Pat. No. 3,654,720 wherein the trigger and certain other parts of the firing mechanism are mounted on a trigger guard that is removably secured to the frame of the revolver, but it is equally applicable to revolvers having a fixed trigger guard and a removable side plate for access to the firing mechanism. As shown in FIG. 1, the major externally visible components of the revolver comprise a frame 10, a barrel 11, a cylinder 12, a hammer 13, a trigger 14, a trigger guard 15, and hand grips 16. The cylinder 12 is formed with a plurality of longitudinally oriented and circumferentially spaced cartridge-receiving chambers 17 and is rotatably mounted on the frame so that each chamber in succession can be brought into alignment with the barrel 11. The exterior surface of the cylinder 12 is formed with a plurality of cylinder latch notches 18 each of which corresponds to one of the chambers 17 of the cylinder 12, each cylinder latch notch 18 being adapted to be engaged by the nose portion of a cylinder latch to prevent rotation of the cylinder when the revolver is fired as hereinafter described.

Figure 2:
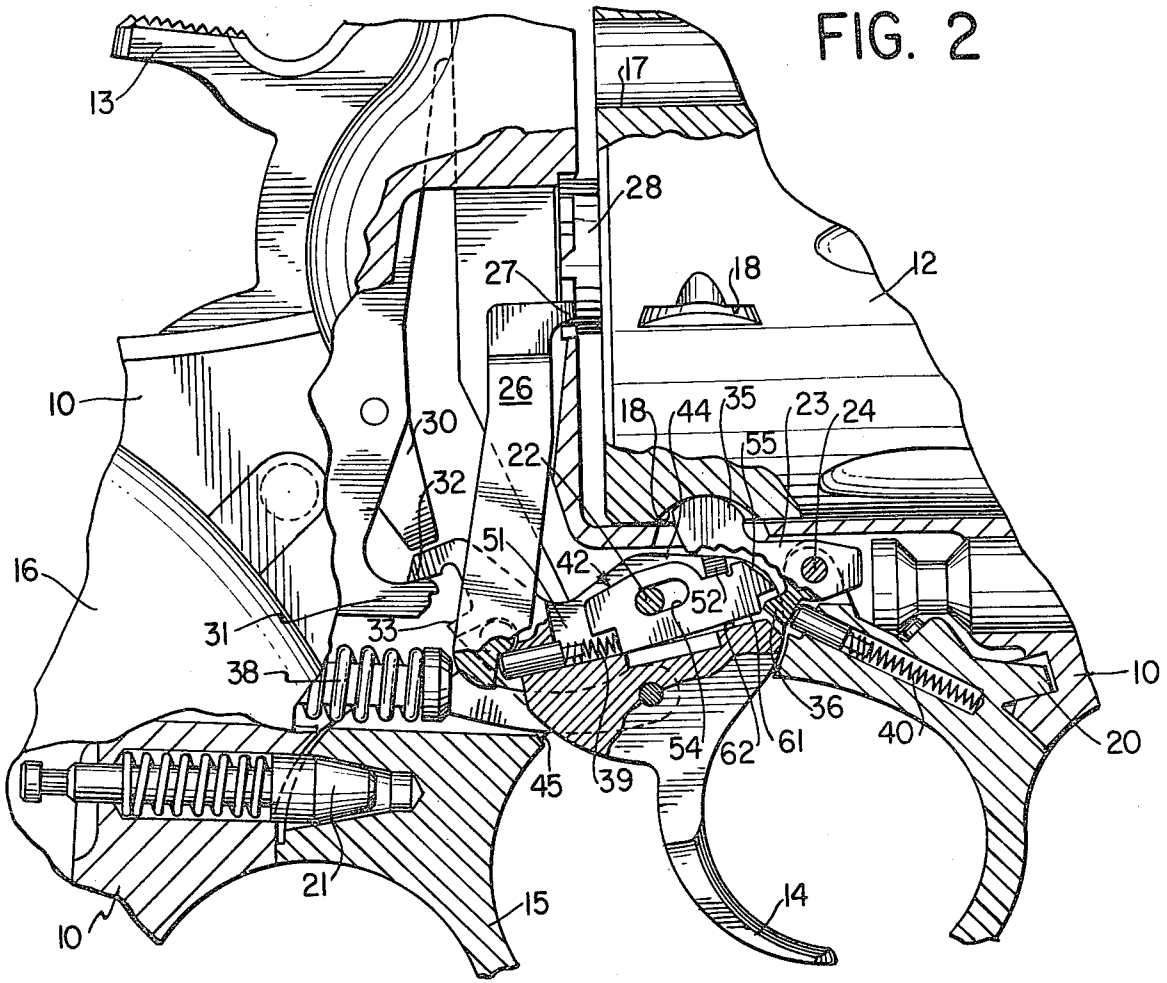
FIG. 2 is an enlarged fragmentary view, partly in section, of the revolver of FIG. 1 showing the firing mechanism at its at-rest position.
Figure 3:
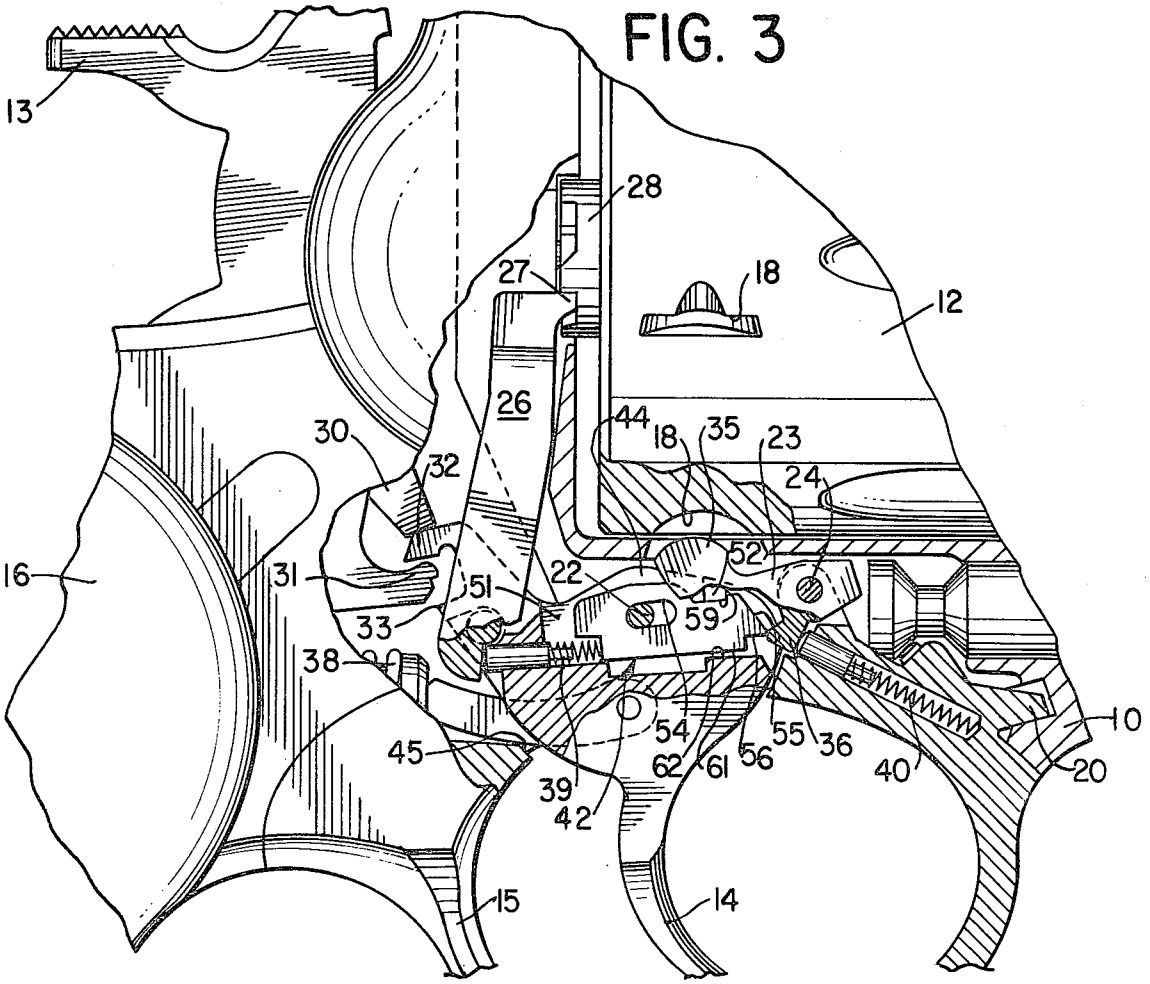
FIG. 3 is a fragmentary view similar to FIG. 2 showing the relative positions of the trigger, cylinder latch actuator and cylinder latch when the firing mechanism first begins to move from its at-rest position to its ready-to-fire position.
Figure 4:
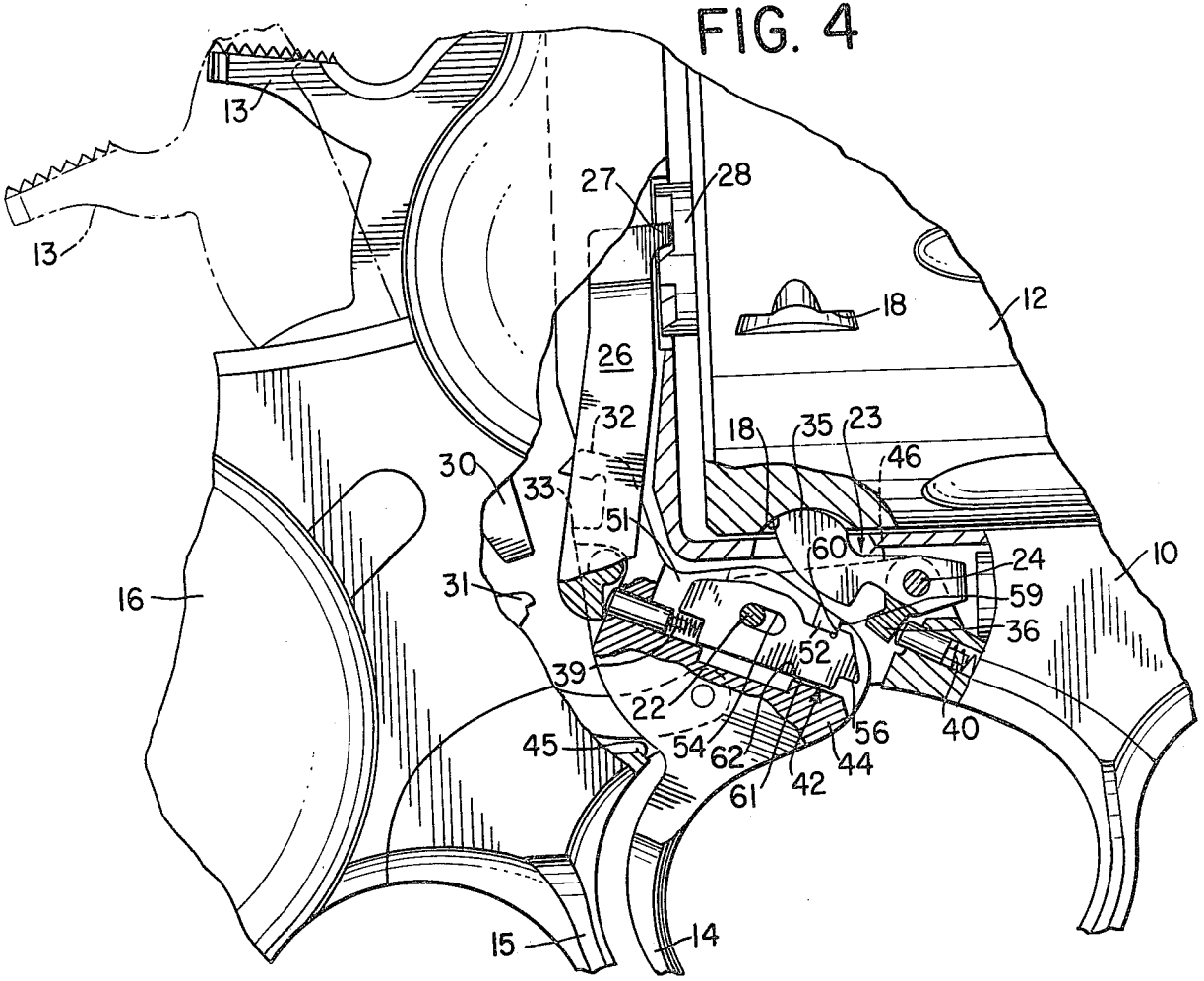
FIG. 4 is a fragmentary view similar to FIG. 2 showing the various parts of the firing mechanism at the moment the revolver is fired.

In the revolver shown in the drawings, the hammer 13 is pivotally mounted on the frame 10 rearwardly with respect to the cylinder 12 in position to strike a cartridge contained in the uppermost chamber 17 of the cylinder when the revolver is fired, the trigger guard 15 is removably secured to the frame 10 by means of the forwardly extending lug 20 and the spring loaded plunger 21 in the manner known in the art, the trigger 14 is pivotally mounted on the removable trigger guard 15 by means of the trigger pivot pin 22, and the cylinder latch 23 is pivotally mounted on the trigger guard by means of the latch pivot pin 24. A cylinder pawl 26 is pivotally mounted on the trigger 14 the upper end 27 of which is adapted to engage the teeth of the cylinder indexing ratchet 28 of the cylinder 12, rotation of the trigger 14 from its at-rest to its ready-to-fire position causing the pawl 26 to move upwardly and thereby rotate the cylinder 12 a sufficient distance to bring the next successive chamber 17 of the cylinder into alignment with the barrel 11 of the revolver. The hammer 13 is provided with a conventional pivoted hammer dog 30 and hammer foot portion 31 which engage and cooperate with the hammer cocking portion 32 and sear 33 of the trigger 14 to cause the hammer and the trigger to rotate together from their at-rest positions to their ready-to-fire positions in the manner known in the art. The cylinder latch 23 has a nose portion 35 and a foot portion 36, the nose portion 35 being adapted to engage successive cylinder latch notches 18 of the cylinder 12 when the cylinder is rotated by the pawl 26 to bring successive chambers 17 of the cylinder into alignment with the barrel of the revolver. A main spring 38 urges the hammer 13 and the trigger 14 to their respective at-rest positions, an actuator spring 39 urges the pawl 26 into engagement with the teeth of the cylinder ratchet 28, and a cylinder latch spring 40 urges the nose portion of the cylinder latch 23 into engagement with the cylinder 12. As previously noted, the nose 35 of the cylinder latch 23 engages the lowermost of the cylinder latch notches 18 of the cylinder 12 to maintain the uppermost chamber 17 of the cylinder in alignment with the barrel 11 when the firing mechanism of the revolver is in its at-rest position as shown in FIG. 2, in its ready-to-fire condition and, in particular, when the revolver is actually being fired as shown in FIG. 4. When, as shown in FIG. 3, the hammer 13 and trigger 14 are being rotated from their at-rest positions to their ready-to-fire positions in preparation for the next shot the cylinder 12 must be free to rotate to bring the next chamber thereof into alignment with the barrel. Accordingly, the cylinder latch 23 first must be rotated to withdraw the nose portion 35 thereof from engagement with the lowermost of the cylinder latch notches 18 of the cylinder 12 and then must be allowed to return to its original position to permit the nose portion 35 to engage the next cylinder latch notch 18 when the next chamber 17 of the cylinder 12 moves into alignment with the barrel 11. In the cylinder latch mechanism of the invention, a unique cylinder latch actuator 42 is mounted on the trigger 14 to contact and momentarily rotate the cylinder latch 23 out of engagement with the cylinder when the trigger is rotated from its at-rest position, the cylinder latch actuator 42 then releasing the cylinder latch to allow it to re-engage the next successive cylinder latch notch 17 of the cylinder 12 when the trigger reaches its ready-to-fire position.

Figure 5:
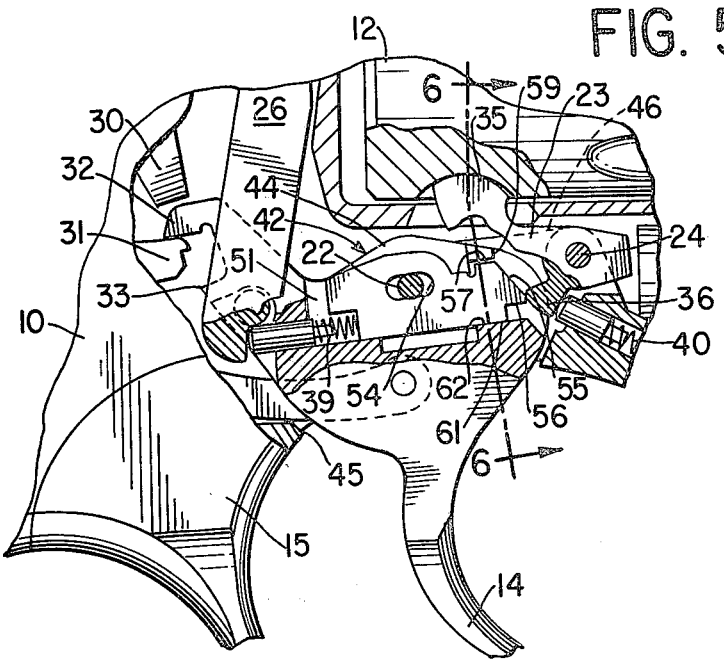
FIG. 5 is a fragmentary view of FIG. 2 showing the relative positions of the trigger, cylinder latch actuator and cylinder latch when the trigger is being returned from its firing position to its at-rest position.
Figure 6:
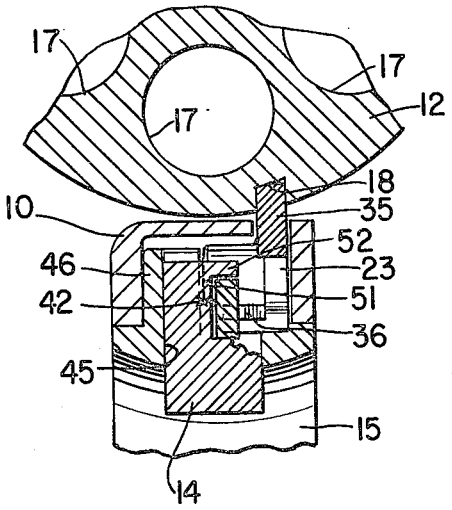
FIG. 6 is a sectional view along line 6—6 of FIG. 5.
Figure 7:
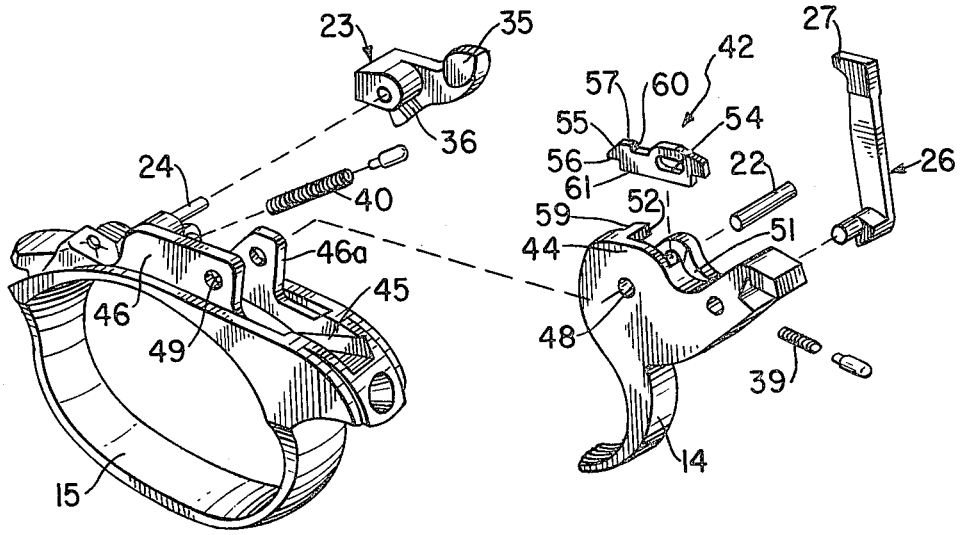
FIG. 7 is an exploded perspective view of the various parts of the firing mechanism mounted on the removable trigger guard of the revolver of FIG. 1.

As shown best in FIGS. 5, 6, and 7 the trigger 14 has a trigger pivot portion 44 that extends upwardly through a longitudinal opening 45 formed in the trigger guard 15 between two longitudinally oriented vertical extensions 46 and 46*a* of the trigger guard, the trigger pivot portion 44 and the vertical extensions 46 being formed with pivot pin holes 48 and 49, respectively, through which the trigger pivot pin 22 extends. As shown best in FIG. 7, the trigger pivot portion 44 of the trigger is formed with a longitudinally extending actuation receiving slot 51 and with an actuator restraining lug 52 that extends transversely over the rearward end of the actuator receiving slot. The cylinder latch actuator 42 is formed with an elongated trigger pivot pin receiving hole 54 and is slidably mounted within the actuator receiving slot 51 on the trigger pivot pin 22 for limited longitudinal and rotational movement on said pin within said slot. The actuator spring 39 urges the cylinder latch actuator 42 forwardly to bring the forward end thereof into contact with the foot portion 36 of the cylinder latch 23. The forward end of the cylinder latch actuator 42 is provided with a forward facing and downwardly slanted cam surface 55, with a cylinder latch contacting element 56 disposed below the cam surface 55 and with a restraining lug engaging member 57 disposed above the cam surface thereof. The actuator restraining lug 52 of the trigger has a forward facing actuator blocking surface 59 and the restraining lug engaging member 57 of the cylinder latch actuator 42 has a rearward facing restraining lug engaging surface 60 adapted to engage the forward facing actuator blocking surface 59 of the actuator restraining lug when these surfaces are brought into contact with each other. The forward end of the cylinder latch actuator 42 is also formed with a downward facing trigger contacting surface 61 and the adjacent portion of the trigger 14 has an upward facing actuator contacting surface 62 adapted to slidably contact the downward facing trigger contacting surface 61 of the cylinder latch actuator when these contacting surfaces are brought into contact with each other.

The revolver may be fired either in a single action or a double action mode of operation. When fired in its single action mode the hammer 13 is actuated manually from its at-rest position to its cocked and ready-to-fire position thereby causing the trigger 14 to rotate to its ready-to-fire position and the cylinder 12 to rotate to bring the next successive chamber thereof into alignment with the barrel 11. When the trigger reaches its ready-to-fire position, the sear 33 of the trigger engages the sear notch of the hammer to maintain these parts at this position. A pull on the trigger 14 releases the hammer 13 and allows it to spring forwardly to fire the revolver. When fired in its double action mode, the trigger 14 is rotated manually from its at-rest position to its ready-to-fire position thereby causing the hammer 13 to rotate to its ready-to-fire position (as shown with dashed lines in FIG. 4) and also causing the cylinder 12 to rotate to bring the next successive chamber thereof into alignment with the barrel 11. Further rotation of the trigger 14 releases the hammer and allows it to spring forwardly to fire the revolver (as shown with solid lines in FIG. 4).

In either case, rotation of the trigger 14 from its at-rest position to its ready-to-fire position causes the cylinder latch contacting element 56 at the forward end of the cylinder latch actuator 42 first to momentarily contact and press against the foot portion 36 of the cylinder latch 23 and then to release the foot portion 36 as described herein. As shown in FIG. 3, at the beginning of the rotation of the trigger 14 the upward pressure of the foot portion 36 against the contacting element 56 causes the forward end of the cylinder latch actuator 42 to move upwardly to bring the restraining lug engaging surface 60 of the actuator into engagement with the actuator blocking surface 59 of the actuator restraining lug 52 thereby blocking rearward movement of the cylinder latch actuator 42 while at the same time the downward pressure of the cylinder latch contacting element 56 against the foot portion 36 causes the nose portion 35 of the cylinder latch 23 to be rotated downwardly out of engagement with the lowermost of the cylinder latch notches 18 of the cylinder 12. As shown in FIG. 4, further rotation of the trigger 14 to its ready-to-fire position causes the cylinder pawl 26 to rotate the cylinder 12 a sufficient distance to bring the next chamber 17 into alignment with the barrel 11 of the revolver while at the same time causing the forward end of the cylinder latch actuator 42 to rotate downwardly out of engagement with the foot portion 36 of the cylinder latch 23 to allow the nose portion 35 thereof to rotate upwardly into contact with the cylinder 12 and to enter and engage the next cylinder latch notch 17 of the cylinder. When the hammer 13 reaches its ready-to-fire position, as indicated by the dashed line in FIG. 4, any additional movement of the trigger 14 will rotate the trigger out of engagement with the hammer and allow the hammer to spring upwardly to its firing position as shown by the solid lines in FIG. 4. After the revolver has been fired and the trigger 14 has been released by the shooter, the mainspring 38 rotates the trigger to its at-rest position. As the trigger 14 approaches its at-rest position as shown in FIG. 5 of the drawing, the forward facing cam surface 55 of the cylinder latch actuator 42 contacts the foot portion 36 of the cylinder latch. The downward pressure of the foot portion 36 against the slanted cam surface 55 causes the forward end of the cylinder latch actuator 42 to rotate downwardly to move the restraining lug engaging member 57 of the actuator out of engagement with the actuator restraining lug 52 of the trigger, and then the rearward pressure of the foot portion against the slanted cam surface causes the cylinder latch actuator 42 to move rearwardly a sufficient distance to allow the forward end thereof to slide past the foot portion of the cylinder latch as also shown in FIGS. 5 and 6 of the drawing. Final rotation of the trigger to its at-rest position causes the various parts of the firing mechanism to take their at-rest positions shown in FIG. 2 of the drawing.

We claim:

1. In a revolver having a frame; a cylinder rotatably mounted on the frame, the exterior surface of the cylinder being formed with a plurality of circumferentially spaced cylinder latch notches; a trigger pivotally mounted on a trigger pivot pin below the cylinder for rotation from its at-rest position to its ready-to-fire position and return; a trigger spring urging the trigger to its at-rest position; a cylinder pawl pivotally mounted on the trigger for rotating the cylinder when the trigger is pulled; a cylinder latch disposed below the cylinder for successively engaging each of the cylinder latch notches of the cylinder when the cylinder is rotated; and a cylinder latch spring urging the cylinder latch into engagement with said cylinder latch notches; said cylinder latch being withdrawn from engagement with one cylinder latch notch and then engaging the next cylinder latch notch of the cylinder when the trigger is rotated from its at-rest position to its ready-to-fire position; the improvement which comprises:

a trigger having a trigger pivot portion that is formed with a transverse pivot pin hole, with a longitudinally extending actuator receiving slot through which the trigger pivot pin extends and with an actuator restraining lug that extends transversely over the actuator receiving slot formed in said pivot portion; a cylinder latch actuator slidably mounted within said actuator receiving slot and on said trigger pivot pin for limited longitudinal and rotational movement on said pin within said slot; a cylinder latch having a nose portion adapted to engage the cylinder latch notches of the cylinder and a foot portion adapted to engage the forward end of the cylinder latch actuator, said cylinder latch being pivotably mounted on the revolver for rotation of the nose portion thereof into and out of engagement with said cylinder latch notches; and spring means urging the cylinder latch actuator into engagement with the foot portion of the cylinder latch;

rotation of the trigger from its at-rest position to its ready-to-fire position causing the forward end of the cylinder latch actuator to contact and press against the foot portion of the cylinder latch and thereby move the forward end of the cylinder latch actuator upwardly into engagement with the actuator restraining lug of the trigger to block rearward movement of said cylinder latch actuator, and also thereby depress and then release the foot portion of the cylinder latch to rotate the nose portion of the cylinder latch downwardly out of engagement with one of the cylinder latch notches and then upwardly into engagement with the next cylinder latch notch of the cylinder; and rotation of the trigger from its ready-to-fire position to its at-rest position causing the foot portion of the cylinder latch to move the forward end of the cylinder latch actuator downwardly out of engagement with the actuator restraining lug of the trigger and then rearwardly a sufficient distance to allow the forward end of said cylinder latch actuator to clear the rearward end of the foot portion of said cylinder latch.

2. The revolver according to claim 1 in which the revolver has a trigger guard that is removably mounted on the frame below the cylinder, and in which the trigger, the cylinder latch actuator, and the cylinder latch are pivotably mounted on said removable trigger guard.

3. The revolver according to claim 1 in which the cylinder latch actuator is formed with a longitudinally elongated trigger pivot pin receiving hole through which the trigger pivot pin extends.

4. The revolver according to claim 1 in which the cylinder latch actuator is provided with a forward facing cam surface disposed at the forward end of said actuator, with a cylinder latch contacting element disposed at the forward end of said actuator below the cam surface thereof, and with a restraining lug engaging member disposed at the forward end of said actuator above the cam surface thereof;

rotation of the trigger from its at-rest position to its ready-to-fire position bringing the cylinder latch contacting element of the cylinder latch actuator into contact with the foot portion of the cylinder latch and causing said foot portion to move the restraining lug engaging member of the cylinder latch actuator upwardly into engagement with the actuator restraining lug of the trigger thereby blocking rearward movement of said cylinder latch actuator; and rotation of the trigger from its ready-to-fire position to its at-rest position bringing the forward facing cam surface of the cylinder latch actuator into contact with the foot portion of the cylinder latch and causing said foot portion to move the cylinder latch actuator downwardly out of engagement with the actuator restraining lug of the trigger and then rearwardly a sufficient distance to allow the forward end of said cylinder latch actuator to clear the rearward end of the foot portion of said cylinder latch.

5. The revolver according to claim 4 in which the actuator restraining lug of the trigger has a forward facing actuator blocking surface; in which the restraining lug engaging member of the cylinder latch actuator has a rearward facing restraining lug engaging surface adapted to engage the forward facing actuator blocking surface of the actuator restraining lug; and in which the forward end of the cylinder latch actuator has a downward facing trigger contacting surface adapted to slidably contact an upward facing actuator contacting surface of the trigger when said contacting surfaces are in contact with each other;

rotation of the trigger from its at-rest position to its ready-to-fire position causing the foot portion of the cylinder latch to move the forward end of the cylinder latch actuator upwardly to bring the restraining lug engaging surface of the restraining lug engaging member into engagement with the actuator blocking surface of the actuator restraining lug thereby blocking rearward movement of said cylinder latch actuator; and rotation of the trigger from its ready-to-fire position to its at-rest position causing the foot portion of the cylinder latch first to move the said restraining lug engaging surface downwardly out of engagement with the actuator blocking surface of the actuator restraining lug of the trigger and to bring the trigger contacting surface of the cylinder latch actuator into sliding contact with the actuator contacting surface of the trigger, and then to move the cylinder latch actuator rearwardly a sufficient distance to allow the forward end of said cylinder latch actuator to clear the rearward end of the foot portion of said cylinder latch.

6. The revolver according to claim 5 in which the revolver has a trigger guard that is removably mounted on the frame below the cylinder; and in which the trigger, the cylinder latch actuator, and the cylinder latch are pivotably mounted on said removable trigger guard.

7. The revolver according to claim 5 in which the spring means that urges the cylinder latch actuator into engagement with the foot portion of the cylinder latch also urges the cylinder pawl into engagement with the cylinder.

* * * * *